US010214342B2

(12) United States Patent
Parcevaux

(10) Patent No.: US 10,214,342 B2
(45) Date of Patent: Feb. 26, 2019

(54) DISPENSER BOX FOR FRAGILE ITEMS, INCLUDING TUBES FOR CIGARETTES

(71) Applicant: REPUBLIC TOBACCO L.P., Glenview, IL (US)

(72) Inventor: Philippe Parcevaux, Cabestany (FR)

(73) Assignee: REPUBLIC TOBACCO L.P., Glenview, IL (US)

( * ) Notice: Subject to any disclaimer, the term of this patent is extended or adjusted under 35 U.S.C. 154(b) by 0 days.

(21) Appl. No.: 15/420,573

(22) Filed: Jan. 31, 2017

(65) Prior Publication Data

US 2018/0009598 A1 Jan. 11, 2018

(30) Foreign Application Priority Data

Jul. 5, 2016 (FR) ..... 16 56436

(51) Int. Cl.

| | |
|---|---|
| ***B65D 85/10*** | (2006.01) |
| ***A24F 15/02*** | (2006.01) |
| ***B65D 5/72*** | (2006.01) |
| ***B65D 83/02*** | (2006.01) |

(52) U.S. Cl.

CPC ..... *B65D 85/1036* (2013.01); *A24F 15/02* (2013.01); *B65D 5/725* (2013.01); *B65D 83/02* (2013.01); *B65D 85/1009* (2013.01)

(58) Field of Classification Search

CPC ..... B65D 85/00; B65D 85/02; B65D 85/08; B65D 85/10; B65D 85/1009; B65D 85/1036; A24F 15/00; A24F 15/02; A24F 15/06

See application file for complete search history.

(56) References Cited

U.S. PATENT DOCUMENTS

| | | | | |
|---|---|---|---|---|
| 3,596,823 | A * | 8/1971 | Zitzelman | B65D 5/28 206/264 |
| 3,814,301 | A * | 6/1974 | Niepmann | B65D 5/703 206/264 |
| 3,823,865 | A * | 7/1974 | Mechnick | B65D 5/6623 206/264 |
| 3,897,900 | A * | 8/1975 | Gorski | B65D 5/701 206/264 |
| 4,513,863 | A * | 4/1985 | Schillinger | B65D 85/1036 206/264 |
| 5,819,924 | A * | 10/1998 | Sigrist | B65D 85/1027 206/264 |
| 6,834,793 | B2 * | 12/2004 | Sutherland | B65D 5/5415 229/117.13 |
| 2003/0136688 | A1 * | 7/2003 | Venable | B65D 5/542 206/242 |
| 2005/0133388 | A1 * | 6/2005 | Bohdan | B65D 5/28 206/242 |

* cited by examiner

*Primary Examiner* — Steven A. Reynolds
*Assistant Examiner* — Javier A Pagan
(74) *Attorney, Agent, or Firm* — Michael Best & Friedrich LLP

(57) ABSTRACT

A dispenser carton for cigarette tubes having a cutout shaped to outline a flap that is folded on one panel of the carton making it possible, after the cutout has been broken, to open the carton at the flap to access the tubes, while at the same time making it possible to re-close the carton by replacing the flap in its initial closed position.

11 Claims, 4 Drawing Sheets

DISPENSER BOX FOR FRAGILE ITEMS, INCLUDING TUBES FOR CIGARETTES

BACKGROUND

The present invention relates to dispenser boxes for fragile items, including, more specifically, dispenser boxes for cigarette tubes.

Cigarette tubes consisting of tubes made of cigarette paper and generally with a filter, resembling an empty cigarette, are well known. Consumers fill these tubes with tobacco selected according to their own taste.

To this end, cartons 10 which are known from the state of the art dispense tubes, as illustrated in FIGS. 1 and 2, in which empty tubes 100 are placed flat in successive rows of tubes. The cartons 10 may contain 100, 200, 300 tubes or more. The carton are opened at the same time by operating the cover 40 which gives access to the first row of tubes 100.

Dispenser cartons 10 consist of a bottom, four lateral panels 30, and a cover 40 that is folded onto one of the lateral panels 30.

Generally, cover 40 is equipped, on the edge opposite its fold, with a tab or closing flap 42 that fits into a cutout or slot 39 made in front panel 30. Since this type of closing flap 42 and complementary slot 39 may be the subject of numerous manners of construction, they have been only schematically illustrated in the figures.

To open cartons 10 of known type as illustrated in FIGS. 1 and 2, the user exerts pressure on the front side 30 of the box and on cover 40 to release closing flap 42 from slot 39.

However, the use of known cartons 10 is not free of problems. In particular, it is frequently observed that the pressure which must be exerted to open the box could cause damage to the tubes 100, which are very fragile in their empty tobacco-free state, making them unusable later when they are to be filled with tobacco. This pressure could also push some of the tubes 100 out of the box 10, making it difficult to replace them properly and re-close the box. This problem occurs most often the first time the box is opened, but may also occur during subsequent openings of the box.

The purpose of the present invention is to improve dispenser boxes used for fragile items, including particularly empty tubes for cigarettes.

Another purpose of embodiments of the invention is to allow the dispenser boxes to be easily opened as well as easily closed. Yet another purpose is to provide methods that limit the risk of damage to items stored in the dispenser boxes.

SUMMARY

The aforementioned objectives are achieved within the scope of embodiments of the present invention by a dispenser box for fragile items, including particularly empty cigarette tubes, which features a cutout that is shaped to outline a flap that is folded on one panel of the carton, in an angle or corner of the carton, to make it possible, after the cutout has been broken out, to open the carton at the flap to access the items while enabling the carton to be re-closed by replacing the flap into its initial closed position.

DETAILED DESCRIPTION

Figure 1:
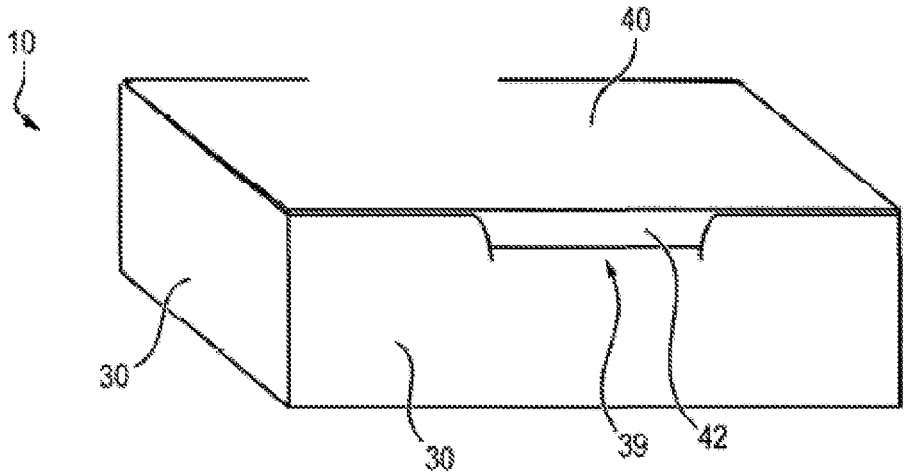
FIGS. 1 and 2 schematically illustrate a dispenser box for cigarette tubes known from the state of the art, respectively in its closed and open positions.
Figure 2:
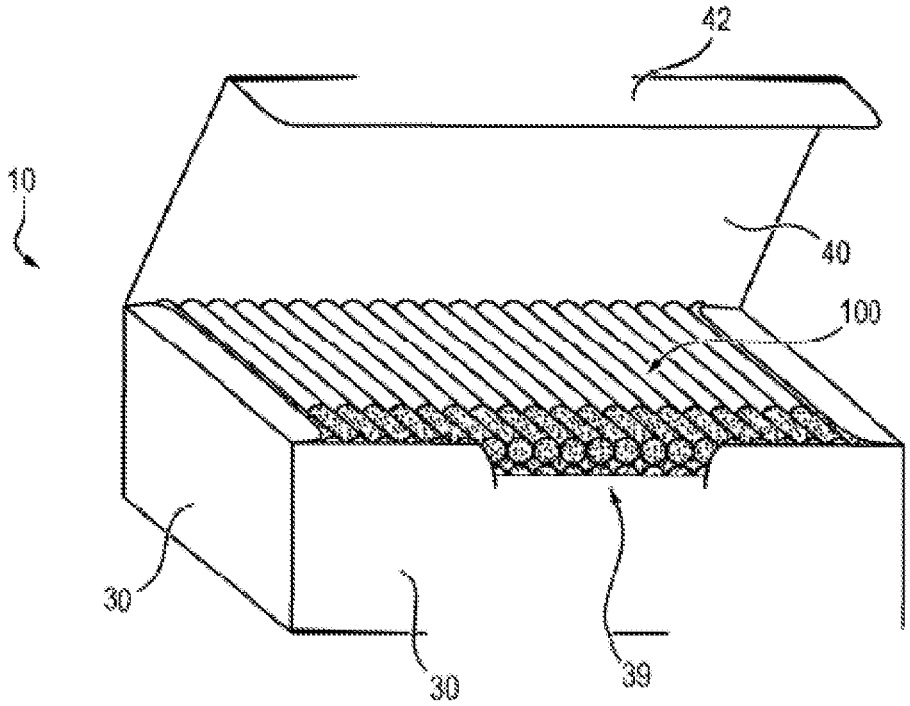

FIGS. 3-7 illustrate an embodiment of a dispenser carton 200 for empty cigarette tubes 100 in accordance with an embodiment of the present invention, including a carton whose primary general structure consists of a bottom 220 that is connected to four body panels 230, 231, and a cover 240. The four body panels are, respectively, parallel and perpendicular to each other.

Three of these panels are visible in the attached figures: a front panel 231 and two opposing lateral panels 232 and 233 and a rear panel opposite front panel 231 that is not visible in the figures.

The panels 230 are connected to each other by edges that are perpendicular to bottom 220, referenced as 234, 235, 236 and 237 in the figures.

The four body panels 230 extend perpendicularly to bottom 220. Bottom 220 is connected to the body panels 230 by respective edges that are parallel and orthogonal between each other, and whose front edge 222 and lateral edges 224 and 226, are illustrated in the attached figures and connect, respectively, bottom panel 220 to front panel 231 and lateral panels 232 and 233.

Cover 240 is folded onto the rear panel about an edge 241 that is parallel to the aforementioned edge 222. Cover 240 consists of a tab or a closing flap 242 that is shaped to fit into a cutout or slot 239 provided in front panel 231 to keep cover 240 in the closed position by fitting it between flap 242 and slot 239 as illustrated in FIG. 3.

Here again, closing flap 242 and complementary slot or cutout 239 are illustrated schematically in the figures. Closing flap 242 and slot or cutout 239 may be subject to numerous variations.

The presence of a cover 240 that is shaped to be alternately opened and closed makes it possible to fill carton 200 with empty cigarette tubes 100 when the cover is open.

Figure 3:
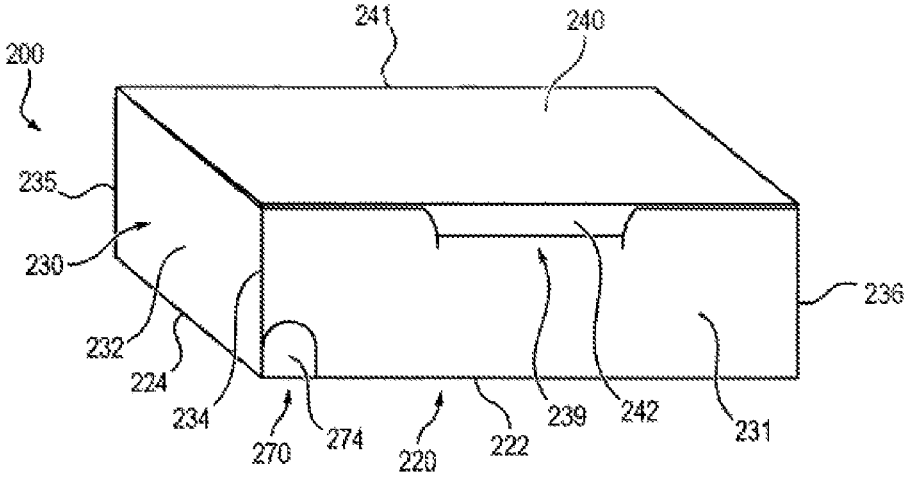
FIG. 3 shows an embodiment of a dispenser box in accordance with the present invention in a view similar to that of FIG. 1.

As can be seen in FIG. 3 et. seq., according to an embodiment of the invention, carton 200 consists, among other things, of a flap 270 that is outlined by a cutout 250. Flap 270 is positioned at an angle or corner of the carton to make it possible, after cutout 250 has been broken, to open carton 200 at flap 270 in order to allow access to items 100 while still allowing carton 200 to be closed by replacing flap 270 to its initial closed position.

As previously indicated, according to the invention, cutout 250 is placed at the level of one corner of carton 200, preferably on a corner opposite cover 240 and, still more specifically, preferably at front panel 231 and bottom 220.

Figure 5:
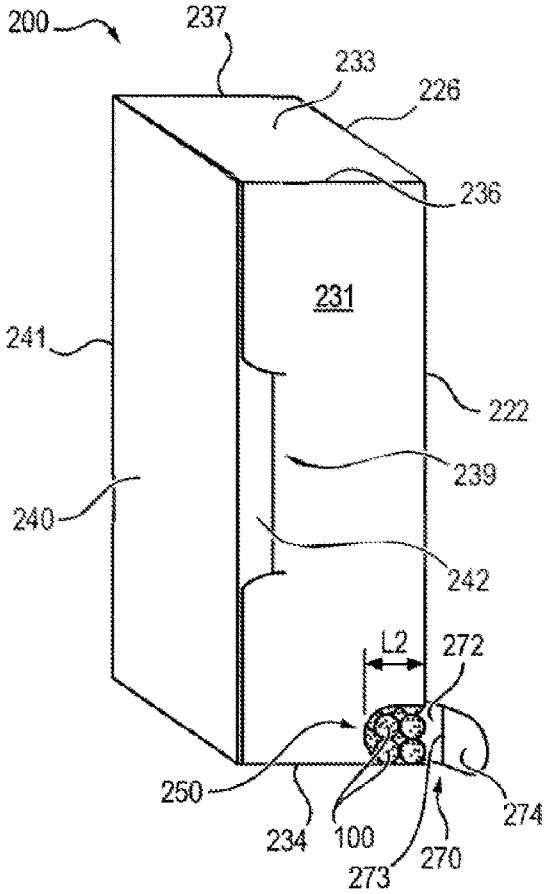
FIGS. 5 and 6 show two perspective views of the same dispenser box embodiment, with the flap in the open position to allow access to items within the box.
Figure 6:
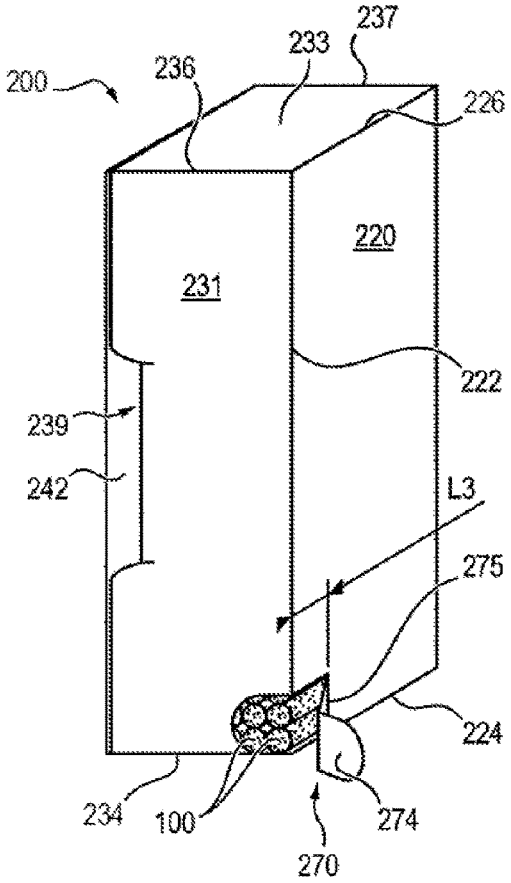
Figure 7:
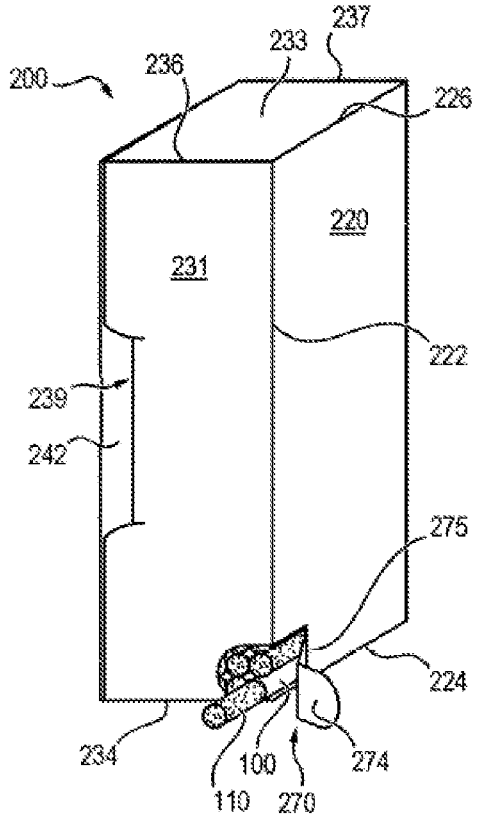
FIGS. 7 and 8 show similar views that schematically illustrate the extraction of an empty tube for cigarettes from a dispenser box embodiment, which has been opened using the flap in accordance with an embodiment of the invention.
Figure 8:
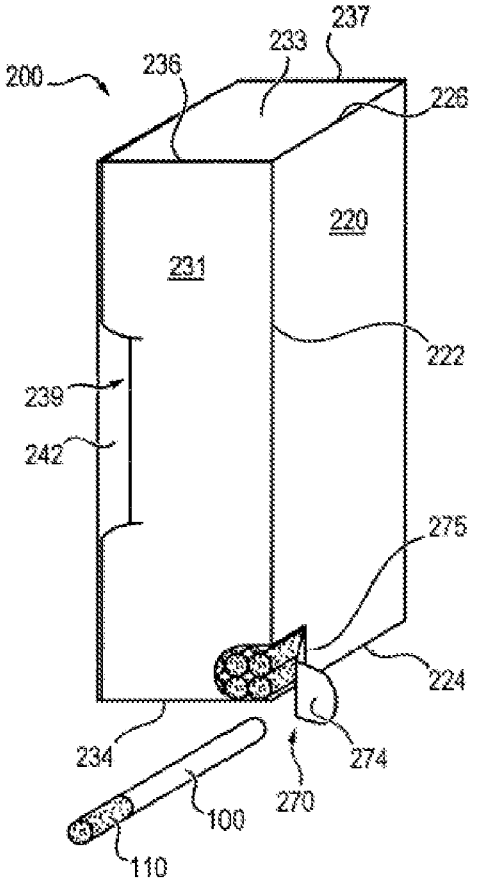

According to the invention, cutout 250 is shaped to outline an L-shaped flap 270 consisting of two tab portions 272, 274 as best seen in FIGS. 5 and 6. The two tab flap portions 272, 274 are on opposite sides of a fold line 273 that coincides at its origin with one edge of the carton, preferably the front lower edge 222 which connects bottom 220 to front panel 231. Flap portion 272 is formed from bottom 220. Flap portion 274 is formed from front panel 231. Flap 270 is thus formed from bottom 220 folded around a straight line 275 that is parallel to the front edge 222.

The fold edge 275 in flap 270 on bottom 220 is, preferably, formed from a crease or score in bottom 220, for example by localized creasing or scoring of the material constituting the bottom 220 at this fold line 275, in order to cause a reduction in thickness or stiffness of the panel comprising bottom 220 along this line 275.

Cutout 250 is outlined, preferably, by aligned discontinuous cutout lines. One part of cutout 250 coincides, as can be seen upon examination of the figures, with the edges of carton 200, preferably edge 224 connecting bottom 220 to lateral panel 234 and edge 222 connecting bottom 220 to front panel 231.

More particularly, cutout 250 is, in this way, outlined by two straight lines 252, 254 that are generally parallel to each other. One of these lines 252 consists of two segments that extend generally in parallel to edges 224 and 234, which connect, respectively, bottom 220 to lateral panel 232 and front panel 231 to lateral panel 232, away from these edges 224 and 234. The other line 254 consists of two segments that coincide with a part of the aforementioned edges 224, 234 which connect, respectively, bottom 220 to front panel 231 and lateral panel 232 to front panel 231.

Cutout 250 includes a curved segment 256, preferably in the form of a semi-circle connecting the ends of lines 252, 254 opposite fold 275. Segment 256 extends like the ends of lines 252, 254 opposite the fold line 275 in the front panel 231. This segment 256 outlines a convex flap 270 and, consequently, an additional concave opening made in the carton.

The width L1 of flap 270 separating the two straight segments 252, 254 of cutout 250, which are generally parallel to each other, is greater than the cross-section or diameter of tubes 100, and preferably greater than twice this cross-section. Typically, the width L1 of flap 270 is on the order of 2.5 times the diameter of cigarette tubes 100. For example, according to the invention, the width L1 of flap 270 is preferably between 10 and 30 mm inclusive, preferably between 15 and 25 mm inclusive, and very advantageously on the order of 20 mm.

Likewise, the length L2 of the end tab 274 of flap 270 formed in the front panel 231 is greater than the diameter or cross-section of items 100, preferably greater than twice this cross-section and, very advantageously, on the order of 2.5 times this cross-section. In other terms, length L2 is preferably on the order of 2.5 times the diameter of the cigarette tubes.

Within the scope of the embodiments of the invention, length L2 is thus preferably between 10 and 30 mm inclusive, advantageously 15 and 25 mm and very preferentially on the order of 20 mm. Length L2 is considered to be the distance between the top of the curved segment 256 and the fold line 273 that coincides with edge 222.

The distance L3 between the fold line 275 of flap 270 and the carton front edge 222 corresponds to the length of tab 272 of the flap adjacent to fold line 275, and is preferably equal to about half of the length of the filter ends 110 of the cigarette tubes, for example, between 5 and 20 mm inclusive, and very advantageously on the order of 10 mm. The curve radius of the curved segment 256 is preferably equal to half of width L1.

Within the scope of the invention, it is moreover preferable to provide a means for re-closing flap 270 by replacing this latter in the closed position on carton 200. The aforementioned means are, preferably, formed at cutout edge 250, which is not strictly straight, after flap 270 is opened. This type of not-strictly-straight edge may be obtained by a discontinuous or perforated cutout 250. The areas of the cutout line that do not correspond in thickness, to a complete cutout of the material comprising the carton 100 in its thickness, thus constitutes a material that is torn away when flap 270 is opened and creates slight localized projections that constitute a means of attaching flap 270 onto the body of carton 100 when flap 270 is put back into position.

As can be seen in the attached figures, in particular FIGS. 5, 6, 7 and 8, within the scope of an embodiment of the invention, cutout 250 and therefore flap 270 are opposite the filter end 110 of cigarette tubes 100. For this reason, the tubes are placed in carton 200 with their filter ends 110 adjacent to front panel 231, which extends perpendicularly to front panel 231, i.e. in parallel to bottom 220 and to lateral panels 232 and 233.

Carton 200 may be constructed of any appropriate material that is amenable to making a cutout 250 in it as well as to the formation of a flap 270. According to the invention, carton 200 is preferably made of cardboard. Carton 200 may, as a variation, be made of composite material.

Of course, the present invention is not limited to the manner of embodiment that was just described, but can be extended to all variations within the present teaching.

Figure 4:
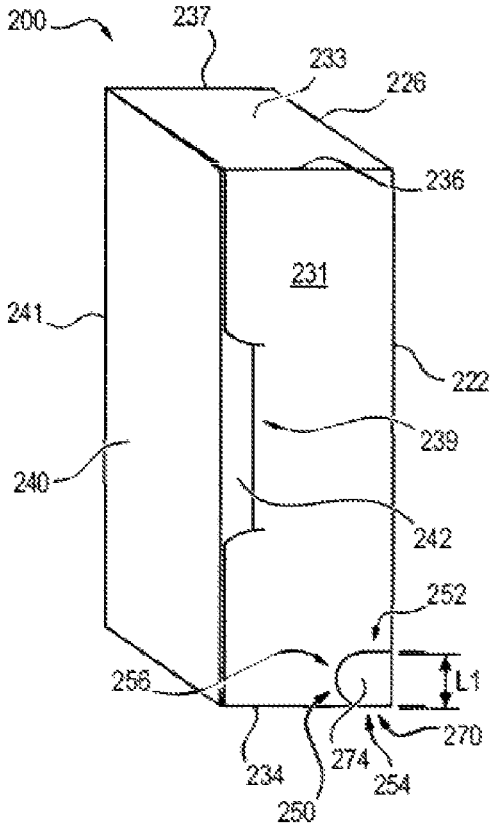
FIG. 4 shows a similar view of an embodiment of a dispenser box in accordance with the present invention, in a preferred position of for dispensing items from a reclosable flap in the box.

As can be seen in FIG. 4 et seq., carton 200 in compliance with the present invention is preferably used by positioning carton 200 on a horizontal support along its smaller lateral side 232, adjacent to cutout 250. This way, the invention makes it possible, by simple gravity, for almost all of the tubes 100 to flow out of the carton without specific handling. To access any remaining tubes 100, carton 200 be slightly inclined along on its edge 224 such that the flap 270 is located at the lowest point of the dispenser box.

The system in compliance with an embodiment of the present invention, which consists of a pre-cutout opening in one angle of the front side of the carton, makes it possible to open the carton without exerting pressure on tubes 100. The positioning of cutout 250 on the filter end 110 of the cigarette tubes makes it possible to avoid damaging the tubes 100 while they are being dispensed. The use of a re-closeable flap 270 makes it possible to prevent the remaining tubes 100 from coming out by themselves after the flap is formed.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

Elements in the Figures

| | |
|---|---|
| 10 | prior art cartons that dispense cigarette tubes |
| 30 | front panel or side |
| 39 | cut out or slot |
| 40 | cover |
| 42 | tab or closing flap |
| 100 | cigarette tubes |
| 102 | empty cigarette tubes |
| 110 | filter end of cigarette tubes |
| 200 | dispenser carton |
| 220 | bottom of dispenser carton |
| 222 | front edge of carton |
| 224, 226 | lateral edges of carton |
| 230 | panels of dispenser carton |
| 231 | front panel dispenser carton |
| 232, 233 | opposing lateral panels of dispenser carton |
| 234, 235, 236 and 237 | carton edges perpendicular to the bottom of carton |
| 239 | cutout or slot in front panel |
| 240 | cover of dispenser carton |
| 242 | carton closing flap |
| 250 | cutout |
| 252, 254 | generally parallel straight lines |
| 256 | curved segment of cutout |
| 270 | L-shaped flap |
| 272, 274 | tabs |
| 275 | crease or fold line |
| L1 | width of flap 270 separating straight segments |
| L2 | distance between top of curved segment of flap and fold line |
| L3 | distance between fold line of flap and carton front edge |

What is claimed is:

1. A dispenser carton containing a plurality of empty paper cigarette tubes comprising:

a plurality of empty paper cigarette tubes having a predetermined diameter and filter ends;

a rectangular carton with an interior containing the empty cigarette tubes, the container including an openable and closeable cover enabling the carton to be filled with the empty paper cigarette tubes, a bottom panel and four side panels, the bottom panel and four side panels intersecting along fold lines defining carton edges, and a cutout extending from the bottom panel to one of the side panels, with parallel perforated lines outlining and comprising, when broken, the sides of an L-shaped folded replaceable flap having end and intermediate flap portions on opposite sides of a fold line of the carton, the end flap portion having a rounded end, and the flap extending only from the one side panel to the bottom panel making it possible, after the cutout has been broken, to open the carton at the flap to access the tubes in the interior of the carton;

the flap having a width and a height where the width and height of the flap on the front panel of the carton are greater than the cigarette tube diameter and no more than 2.5 times the diameter of the tubes; and the cigarette tubes being disposed in the carton with the replaceable flap of the carton opposite the filter ends of the tubes.

2. A dispenser carton according to claim 1, in which the cutout is opposite to the carton cover.

3. A dispenser carton according to claim 1 in which the flap is folded on the bottom panel of the carton around a line that is parallel to one edge of the carton.

4. A dispenser carton according to claim 1 in which the L-shaped flap comprises two perpendicular tab portions on two adjacent panels of the carton.

5. A dispenser carton according to claim 1 in which the flap is folded onto one panel of the carton.

6. A dispenser carton according to claim 1 in which the flap is folded onto one panel of the carton at a distance from one edge on the order of half of the length of one predetermined filter end length.

7. The dispenser carton of claim 6 in which the length of the intermediate flap portion is equal to about half the predetermined filter end length.

8. The dispenser carton of claim 6 in which the length of the intermediate flap portion is between 5 and 20 mm.

9. The dispenser carton of claim 6 in which the length of the intermediate flap portion is 10 mm.

10. The dispenser carton of claim 1 in which the width of the end flap portion is greater than twice the predetermined cigarette tube diameter.

11. The dispenser carton of claim 1 including means for reattaching the flap to the carton comprising localized projections on the portion of the carton from which the rounded end of the flap is broken.

* * * * *